US006646237B2

(12) United States Patent
Liu

(10) Patent No.: US 6,646,237 B2
(45) Date of Patent: Nov. 11, 2003

(54) SAFETY CONTROL CIRCUIT FOR ELECTRIC WATER HEATER

(76) Inventor: Daniel Liu, 4F, No. 10, Alley 59, Lane 42, Min Chuan Road, Hsin Tien, Taipei Hsien (TW)

( * ) Notice: Subject to any disclaimer, the term of this patent is extended or adjusted under 35 U.S.C. 154(b) by 51 days.

(21) Appl. No.: 10/087,799

(22) Filed: Mar. 5, 2002

(65) Prior Publication Data

US 2003/0168441 A1 Sep. 11, 2003

(51) Int. Cl.[7] ..... H05B 1/02; F24H 1/00

(52) U.S. Cl. ..... 219/481; 219/497; 219/505; 392/449

(58) Field of Search ..... 219/481, 497, 219/505, 492; 392/449, 454

(56) References Cited

U.S. PATENT DOCUMENTS 4,523,084 A * 6/1985 Tamura et al. ..... 219/497
5,552,998 A * 9/1996 Datta ..... 324/601
6,080,973 A * 6/2000 Thweatt, Jr. ..... 219/497

FOREIGN PATENT DOCUMENTS

JP 2-203152 * 8/1990
JP 9-178265 * 7/1997

* cited by examiner

*Primary Examiner*—John A. Jeffery
(74) *Attorney, Agent, or Firm*—Rosenberg, Klein & Lee

(57) ABSTRACT

A safety control circuit for an electric water heater includes a voltage detection circuit, a current detection circuit, a load-resistance calculation unit, and a central processing unit. The load-resistance calculation unit calculates load-resistance reference value and dynamic load-resistance values based on voltage value and current value detected by the voltage detection circuit and the current detection circuit, respectively. The central processing unit determines whether there is water supplied to the electric water heater based on the load-resistance reference value and the dynamic load-resistance values sent to the central processing unit by the load-resistance calculation unit. When a difference between the two values is larger than a predefined value, the central processing unit drives a switch to turn off and thereby cut off power supply to the water heater.

7 Claims, 3 Drawing Sheets

SAFETY CONTROL CIRCUIT FOR ELECTRIC WATER HEATER

BACKGROUND OF THE INVENTION

1. Field of the Invention

The present invention relates to a control circuit for an electric water heater, and more particularly to a safety control circuit for electric water heater to detect the dry heating of an electric water heater at ceasing of water supply.

2. Description of the Prior Art

Water heaters are common used home appliances and can be generally divided into two types, namely, gas-fired water heaters and electric water heaters. The electric water heaters are convenient, safe, ready for use and are therefore widely adopted. For a place at where a large volume of hot water is to be supplied, a thermal storage type of electric water heater is normally adopted.

The electric water heater usually includes a heating element made of nickel-chrome wire which is continuously heated whenever power supply to the water heater is maintained , even if water supply to the water heater is terminated. Thus, the electric water heater is subjected to damage that may cause a fire.

The currently commercially available electric water heaters have many shortcomings. They generally lacks good safety designs. For example, the control circuits in some of the commercially available electric water heaters include a mechanical or an electronic timer to control on and off of the electric water heaters at preset time. However, these mechanical or electronic timers are unable to detect whether a water heater that is under drying heating without water supply.

Moreover, the control switch of commercial water heater cannot provide overcurrent protection. In case of overcurrent, the electric water heaters will be damaged and it easily causes fire.

Furthermore, the control circuits do not include the delay power-on function. When the power supply is recovered from a power failure, the electric water heaters and other indoor electric appliances are re-started and powered on almost at the same time to possibly cause an instantaneous overcurrent that would result in tripped breakers.

Also, the control circuits have a switch that is turned on or off as soon as the power is supplied or cut off respectively, and it will generate surge current at the switch which will reduce its shelf life thereof.

It is therefore desirable to develop a control circuit for the electric water heater to provide multiple safety protections thereof.

SUMMARY OF THE INVENTION

A primary object of the present invention is to provide a safety control circuit for electric water heater, which can detect whether the water heater is at a state of dry heating without water supply while power supply is still maintained, and which can automatically cut off power supply to the water heater when dry heating is detected.

Another object of the present invention is to provide a control circuit for electric water heater adapted to automatically power off the electric water heater when its circuit or element is damaged and results in an abnormal overcurrent.

A further object of the present invention is to provide a control circuit for electric water heater, which can provide time-control to reduce power consumption of the electric water heater.

A still further object of the present invention is to provide a control circuit for electric water heater enabling delay power-on of the electric water heater, so that power may be supplied to the electric water heater at a delayed time after a power failure.

A still further object of the present invention is to provide a control circuit for electric water heater enabling elimination of surge current at on and off of a switch of the electric water heater, so that the shelf life of switch may be prolonged at reduced frequency of maintenance.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
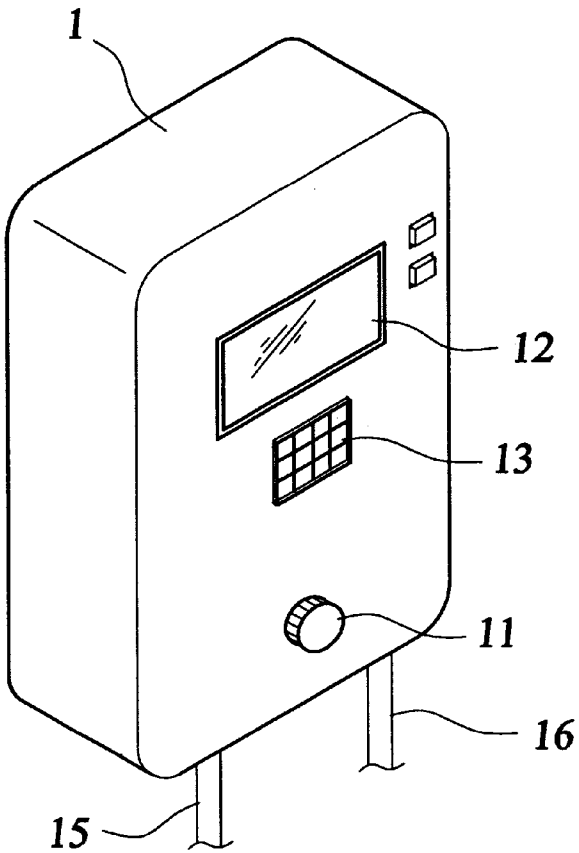
FIG. 1 is a perspective view of an embodiment of the electric water heater in accordance with the present invention.
Figure 2:
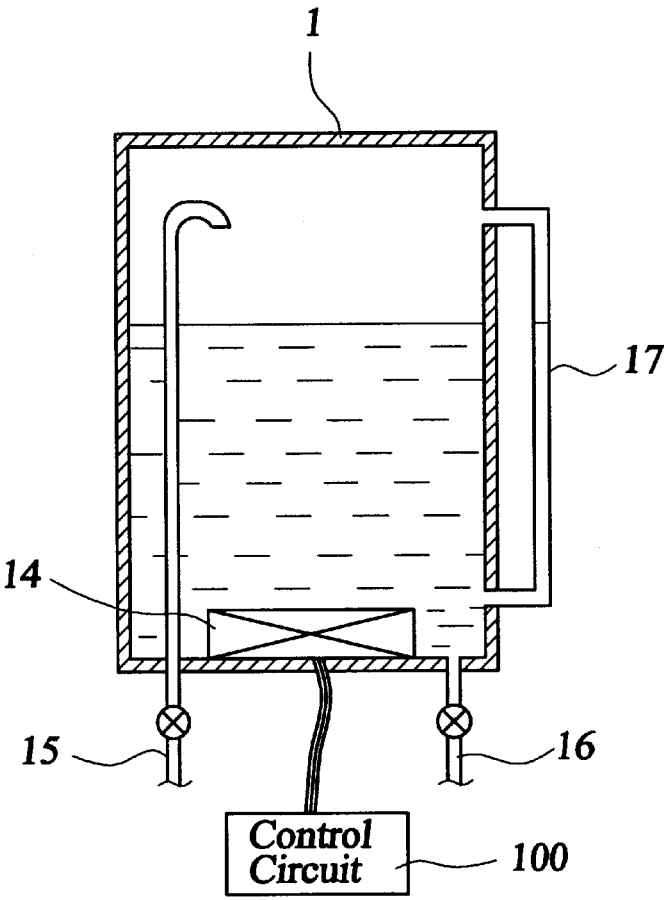
FIG. 2 is a schematic sectional view of the electric water heater showing arrangements of related parts therein.

Please refer to FIG. 1 which is a perspective view of an electric water heater 1 employing a safety control circuit of the present invention, and to FIG. 2 that is a schematic sectional view of the electric water heater 1 of FIG. 1 showing arrangements of related parts therein. As shown, the electric water heater 1 is provided with a thermostat 11 on a front panel of a housing thereof, a display unit 12, and a group of setting keys 13.

Referring to FIG. 2, the electric water heater 1 includes an internally mounted electric heating element 14, to which an electric current is supplied to generate required and sufficient heat energy to the electric water. Cold water is supplied into the electric water heater 1 via a water inlet pipe 15 and hot water flows out of the electric water heater 1 via a water outlet pipe 16. Typically, there is a level inspection tube 17 mounted to one side of the electric water heater 1 for visual inspection of water level in the water heater 1. The electric water heater 1 is controlled through a control circuit 100 of the present invention to provide various safety functions.

Figure 3:
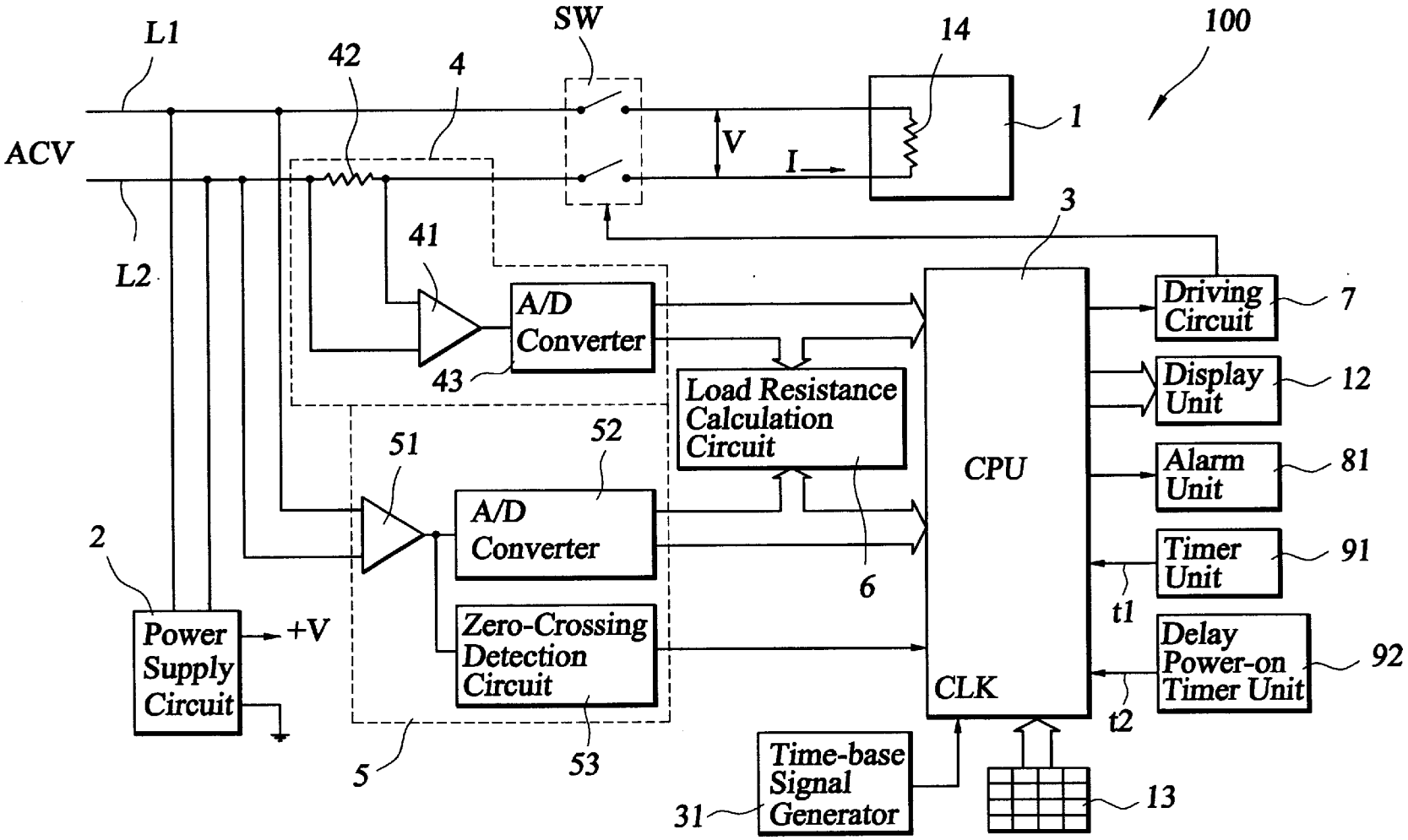
FIG. 3 is a control circuit diagram of the present invention.

FIG. 3 is a circuit diagram of the control circuit 100 of the present invention. The electric water heater 1 is connected to an alternating current source ACV via a switch SW. A power supply circuit 2 obtains a power supply via power cords L1, L2 of the alternating current source ACV, and converts the alternating current into a direct current (DC) voltage output +V, which is then used as a working voltage of the control circuit 100.

The control circuit 100 includes a central processing unit 3 (CPU) for receiving signals, operating various data, displaying controls, and driving different controls. A time-base signal generator 31 is able to generate a time-base signal CLK and sends it to the central processing unit 3 as a basis for time counting and time display. The central processing unit 3 is also connected to a group of setting keys 32, with which users may set different data for the electric water heater 1.

A current amplifier 41 is used to detect a current value I of current flown to the electric water heater 1 by serially connecting a current detection element 42 to the power cord L2 and connecting two inputs of the current amplifier 41 to two ends of the current detection element 42. The current detection element 42 may be a resistance and must be serially connected to an active line of the power cords. An analog-to-digital (A/D) converter 43 is connected to an output of the current amplifier 41 for converting an analog current value generated by the current amplifier 41 into a digital signal and sending the latter to the central processing unit 3. The current amplifier 41, the current detection element 42, and the A/D converter 43 constitute a current detection circuit 4 of the safety control circuit 100 of the present invention.

A voltage amplifier 51 is connected at two inputs to the power cords L1, L2, respectively, for detecting a voltage value V of voltage applied to the electric water heater 1. An analog-to-digital (A/D) converter 52 is connected to an output of the voltage amplifier 51 for converting the analog voltage value V generated by the voltage amplifier 51 into a digital signal and sending the latter to the central processing unit 3. A zero-crossing detection circuit 53 is also connected to the output of the voltage amplifier 51 for detecting a zero-crossing time point of the AC voltage applied to the electric water heater 1, and sending an output signal to the central processing unit 3. The voltage amplifier 51, the A/D converter 52, and the zero-crossing detection circuit 53 constitute a voltage detection circuit 5 of the safety control circuit 100 of the present invention.

A load-resistance calculation unit 6 is connected to an output of the A/D converter 43 of the current detection circuit 4 and an output of the A/D converter 52 of the voltage detection circuit 5 at the same time. When the switch SW is turned on, the alternating current source ACV is supplied to the electric heating element 14 in the electric water heater 1. At this point, the load-resistance calculation unit 6 operates to calculate a load-resistance reference value R=V/I of the electric water heater 1 based on the current value I and the voltage value V detected at the current detection circuit 4 and the voltage detection circuit 5, respectively. When the electric water heater 1 is continuously supplied with the AC current source ACV, the current detection circuit 4 and the voltage detection circuit 5 keep detecting the current value I and the load voltage value V of the water heater 1, respectively, and based on which the load-resistance calculation unit 6 keeps calculating and provides dynamic load-resistance values R(t).

The load-resistance reference value R and the dynamic load-resistance values R(t) are sent to the central processing unit 3, and the central processing unit 3 will determine whether there is water in the electric water heater 1 based on the received load-resistance reference value R and the dynamic load-resistance values R(t).

At the state of dry heating, at which no water is supplied to the heated water heater 1, due to the thermal characteristic such as a positive thermal coefficient of heating element 14, the dynamic load-resistance values R(t) will increase. The central processing unit 3 compares the dynamic load-resistance values R(t) with the load-resistance reference value R. When the value R(t) exceeds the value R by a predefined portion, for example, 3%, it is determined the electric water heater 1 is under a state of dry heating without water supplying. The central processing unit 3 will then turn off the switch SW via control from a driving circuit 7, so that power supply to the electric water heater 1 is immediately cut off to avoid failure of the electric water heater 1 as well as any possible fire.

A display unit 12 is connected to an output port of the central processing unit 3 for displaying a temperature of and related information about the electric water heater 1. When the power supply to the electric water heater 1 is automatically cut off at dry heating as mentioned above, the display unit 12 will simultaneously display related information such as "NO WATER" to warn the user. Alternatively, an alarm unit 81 may be used to produce alarm signal. The user can therefore immediately inspect the electric water heater 1 for water level in the heater 1 and/or normal supply of water via the inlet water pipe 15 to the heater 1. The power to the electric water heater 1 automatically is restarted only when a normal supply of water to the heater 1 is recovered.

In the case of an abnormal overcurrent resulted from failed circuit or electronic element of the electric water heater 1, the safety control circuit 100 of the present invention is able to detect the overcurrent via the current detection circuit 4 and automatically cuts off the power supply to the heater 1 through the control of the central processing unit 3. Moreover, the zero-crossing detection circuit 53 of the voltage detection circuit 5 enables contacts of the switch SW to close or open only after the zero crossing point, so as to eliminate a surge current at the instant of turning on or off the switch SW. In this manner, the switch SW shelf life may been prolonged at reduced frequency of repair.

The control circuit 100 of the present invention may also include a timer unit 91. A user may set via the group of setting keys 32 a fixed time interval t1, which is sent to the central processing unit 3. For instance, a user may set to cut off the power supply to the electric water heater 1 during daytime when the user is out and turn on the power supply to the heater 1 in the evening when the user is home. This can reduce power consumption resulted from thermostatic control of the heater 1 during daytime.

The control circuit 100 may also include a delay power-on timer unit 92, with which a delay time interval t2 may be set and sent to the central processing unit 3. In the case of a power failure and the subsequent recovery of power supply, the delay power-on timer unit 92 that has been preset to a delay time interval t2 enables a delayed power supply to the electric water heater 1 after lapse of the delay time interval t2, for example, 3 seconds. In this manner, the electric water heater 1 could be re-started at a time different from other electric appliances to prevent a trip-off of breaker due to an instantaneous overcurrent.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A safety control circuit for an electric water heater, said electric water heater comprising an electric heating element that is connected to an alternating current source via a switch; said safety control circuit comprising:

a voltage detection circuit for detecting a voltage value of a voltage applied to said electric water heater;

a current detection circuit for detecting a current value of a current supplied to said electric water heater;

a load-resistance calculation unit for calculating a load-resistance reference value of said electric water heater based on said voltage value and said current value detected by said voltage detection circuit and said current detection circuit, respectively; and said load-resistance calculation unit keeping detection of load voltage value and current value of said electric water heater through said voltage detection circuit and said current detection circuit when said electric water heater is continuously supplied with power, and calculating dynamic load-resistance values of said electric water heater; and a central processing unit for determining whether there is water supplied to said electric water heater based on said load-resistance reference value and said dynamic load-resistance values of said electric water heater supplied by said load-resistance calculation unit; and said central processing unit driving said switch to turn off and thereby cut off power supply to said electric water heater when a difference between said load-resistance reference value and said dynamic load-resistance values being larger than a predefined value.

2. The safety control circuit as claimed in claim 1, wherein the voltage detection circuit comprising:

a voltage amplifier electrically connected to the alternating current source for generating an analog voltage signal;

a voltage zero-crossing detecting circuit for detecting a zero-crossing signal of the analog voltage signal and then sending the zero-crossing signal to the central processing unit; and an analog-to-digital converter for converting the analog voltage signal generated by the voltage amplifier into a digital voltage value, and then sending the digital voltage value to the central processing unit.

3. The safety control circuit as claimed in claim 1, wherein the current detecting circuit comprises:

a current detection element for detecting the current flowing from the alternating current source to the electric heating element and generating a current signal;

a current amplifier for detecting the current signal generated by the current detection element, and then generating an analog current signal; and an analog-to-digital converter for converting the analog current signal generated by the current amplifier into a digital current value, and then sending to the central processing unit.

4. The safety control circuit as claimed in claim 1, further comprising a display unit coupled to the central processing unit.

5. The safety control circuit as claimed in claim 1, further comprising an alarm unit coupled to the central processing unit.

6. The safety control circuit as claimed in claim 1, further comprising a timer unit for setting times at which said electric water heater is powered on and powered off, respectively.

7. The safety control circuit as claimed in claim 1, further comprising a delay power-on timer unit for delaying power supply to said electric water heater by a predefined time after recovery from a power failure.

* * * * *